US007684980B2

(12) United States Patent
Rousseau

(10) Patent No.: US 7,684,980 B2
(45) Date of Patent: Mar. 23, 2010

(54) INFORMATION FLOW TRANSMISSION METHOD WHEREBY SAID FLOW IS INSERTED INTO A SPEECH DATA FLOW, AND PARAMETRIC CODEC USED TO IMPLEMENT SAME

(75) Inventor: Frédéric Rousseau, Montigny-le-Bretonneux (FR)

(73) Assignee: Eads Secure Networks, Montigny le Bretonneux (FR)

( * ) Notice: Subject to any disclaimer, the term of this patent is extended or adjusted under 35 U.S.C. 154(b) by 278 days.

(21) Appl. No.: 10/569,914

(22) PCT Filed: Sep. 6, 2004

(86) PCT No.: PCT/FR2004/002259

§ 371 (c)(1),
(2), (4) Date: Feb. 28, 2006

(87) PCT Pub. No.: WO2005/024786

PCT Pub. Date: Mar. 17, 2005

(65) Prior Publication Data

US 2006/0247926 A1 Nov. 2, 2006

(30) Foreign Application Priority Data

Sep. 5, 2003 (FR) ..... 03 10546

(51) Int. Cl.
*G10L 19/02* (2006.01)

(52) U.S. Cl. ..... 704/229; 704/221; 704/227

(58) Field of Classification Search ..... 704/221, 704/219, 220, 222, 223, 229, 500–504, 200.1, 704/216, 217, 218, 200, 206, 227; 370/487, 370/477, 384, 336; 375/200, 206; 382/100; 384/460; 386/94, 725; 212/270
See application file for complete search history.

(56) References Cited

U.S. PATENT DOCUMENTS 5,291,484 A * 3/1994 Tomita et al. ..... 370/384

(Continued)

FOREIGN PATENT DOCUMENTS

EP 1 020 848 A2 7/2000
WO WO 00/39955 7/2000

OTHER PUBLICATIONS

International Search Report For PCT/FR2004/002259 dated Dec. 28, 2004.

(Continued)

*Primary Examiner*—Huyen X. Vo
(74) *Attorney, Agent, or Firm*—Miller, Matthias & Hull

(57) ABSTRACT

For the transmission of a secondary information flow between a transmitter and a receiver, the secondary information flow is inserted at a parametric vocoder of the transmitter which generates a main information flow. The main information flow is a speech data flow encoding a speech signal and is transmitted from the transmitter to the receiver. Bits from the secondary information flow are inserted into only some of the frames of the main information flow, these frames being selected by a frame mask which is known to the transmitter and the receiver, and/or into a determined frame of the main information flow, by imposing a constraint on only some of the bits of the frame, these bits being selected by a bit mask known to the emitter and the receiver.

23 Claims, 3 Drawing Sheets

U.S. PATENT DOCUMENTS 5,319,735 A * 6/1994 Preuss et al. ..... 704/205
5,757,788 A * 5/1998 Tatsumi et al. ..... 370/336
5,790,759 A * 8/1998 Chen ..... 704/200.1
5,937,000 A * 8/1999 Lee et al. ..... 375/141
6,158,602 A * 12/2000 Zakula et al. ..... 212/270
6,674,861 B1 1/2004 Xu et al.
6,700,989 B1 * 3/2004 Itoh et al. ..... 382/100
7,130,309 B2 * 10/2006 Planka ..... 370/435
2001/0038643 A1 * 11/2001 McParland ..... 370/487

OTHER PUBLICATIONS

ETSI technical specification 3GPP TS 26.101.
NATO STANAG 4591.
ISO/IEC specification 14496-3 sub-part 3.
Specification standard ANSI/TIA/EIA 102.BABA ("APCO Project 25 Vocoder Description").

* cited by examiner

VS1
LINEAR PREDICTOR
11
LP
12
STORE OVER P FRAMES
LP'
ADAPTIVE EXCITER
21
LTP
22
STORE OVER Q SUB-FRAMES
LTP'
FIXED EXCITER
31
FIX
32
STORE OVER R SUB-FRAMES
FIX'
BS FS DS2
MUX
41
DS1
LP'(F[i])
LTP'(SF1(F[i]))
LTP'(SFM(F[i]))
FIX'(SF1(F[i]))
FIX'(SFM(F[i]))
100

INFORMATION FLOW TRANSMISSION METHOD WHEREBY SAID FLOW IS INSERTED INTO A SPEECH DATA FLOW, AND PARAMETRIC CODEC USED TO IMPLEMENT SAME

CROSS-REFERENCE TO RELATED APPLICATION

This is the U.S. National Phase of International Application No. PCT/FR2004/002259 filed 6 Sep. 2004, the entire disclosure of which is incorporated herein by reference.

The present invention relates generally to the field of voice coding and in particular to a method of inserting an information stream into a voice data stream, where the inserted information stream may be a voice data stream at a lower bit rate or a transparent data stream.

TECHNICAL FIELD

The invention finds applications in public mobile radio systems or professional mobile radio (PMR) systems in particular.

BACKGROUND OF THE INVENTION

A voice signal is a sound signal emitted by a human vocal tract.

A codec is a hardware and/or software device for coding and decoding a digital stream. Its coding function transcodes a digital stream of quantized samples of a source signal (a voice signal) in the time domain into a compressed digital stream. Its decoder function effects a pseudoconverse operation with the objective of restoring attributes representative of the signal source, for example attributes perceptible to a receiver such as the human ear.

A voice data stream is a data stream generated by a voice codec when coding a voice signal. A transparent data stream is a binary digital sequence of unspecified content type (computer data or voice data). The data is referred to as "transparent" in the sense that, from an external point of view, all the bits are of equal importance in relation to the correction of transmission errors, for example, so that error corrector coding must be uniform for all the bits. Conversely, if the stream is a stream of voice bits, some bits are more important to protect than others.

A voice (or speech) codec, also referred to as a vocoder, is a dedicated codec adapted to code a quantized voice signal and to decode a stream of voice frames. In particular, its coding function has a sensitivity that depends on the characteristics of the voice of the speaker and a low bit rate associated with a frequency band that is narrower than the general audio frequency band (20 Hz-20 kHz).

There are several families of voice coding techniques, including techniques for coding the waveform of the voice signal (for example ITU-T G.711 PCM A/μ law coding), source model coding techniques, of which code-excited linear prediction (CELP) coding is the best known, perceptual coding, and hybrid techniques based on combining techniques belonging to two or more of the above families.

The invention aims to apply source model coding techniques, which are also known as parametric coding techniques, because they are based on the representation of excitation parameters of the voice source and/or of parameters describing the spectral envelope of the signal emitted by the speaker (for example a linear prediction coding model exploiting the correlation between consecutive values of parameters associated with a synthesis filter or a cepstral model) and/or of sound parameters depending on the source, for example the amplitude and the perceived fundamental center frequency ("pitch"), the pitch period, and the amplitude of the energy peaks of the first harmonics of a pitch frequency at different intervals, its voicing rate, its melodic qualities, and its stringing characteristics.

A parametric vocoder uses digital voice coding employing a parametric model of the voice source. In practice, a parametric vocoder associates a plurality of parameters with each frame of the voice stream, firstly linear prediction (LP) spectrum parameters, also known as LP coefficients, for example, or linear prediction coding (LPC) coefficients, which define a linear prediction filter of the vocoder (short-term filter); secondly, adaptive excitation parameters associated with one or more adaptive excitation vectors, which are also known as long-term prediction (LTP) parameters or adaptive prediction coefficients, and which define a long-term filter in the form of a first excitation vector and an associated gain to be applied at the input of the synthesis filter; and thirdly fixed excitation parameters associated with one or more fixed excitation vectors, which are also known as algebraic parameters or stochastic parameters, and which define a second excitation vector and an associated gain to be applied at the input of the synthesis filter.

The document EP-A-1 020 848 discloses a method of transmitting auxiliary information in a main information stream corresponding to a voice signal, said auxiliary information being inserted in a CELP vocoder that codes the voice signal, replacing the index of the adaptive excitation vector and/or the index of the fixed excitation vector. To be more precise, the auxiliary information bits are inserted in the vocoder of the sender in place of bits normally coding the corresponding index and the value of the gain is set to zero in order to advise the vocoder of the receiver of this substitution.

One drawback is that inserting an auxiliary information stream into the main information stream is not discreet, in that it is sufficient to note the zero value of the gain to know that the bits normally allocated to coding the associated index in fact contain auxiliary information. This is considered to be a drawback of the method when used in a system in which transmission confidentiality is important.

SUMMARY OF THE INVENTION

The invention enables the discreet insertion of a secondary stream into a main stream corresponding to a voice stream. Other objects of the invention aim to maximize the secondary stream bit rate that can be inserted at the same time as preserving the coding performance of the main stream as much as possible vis-à-vis attributes of the source (i.e. by preserving the quality perceived on listening to the synthesized voice stream). Another object of the invention is simultaneously to preserve the performance of secondary stream coding vis-à-vis attributes of the source of the secondary stream, in particular when it is also a voice stream.

In accordance with a first aspect of the invention, a method of transmitting a secondary information stream between a sender and a receiver, includes inserting said secondary information stream in a parametric vocoder of the sender generating a main information stream that is a voice data stream coding a voice signal and is transmitted from the sender to the receiver, in which method bits of the secondary information stream are inserted:

- into only some of the frames of the main information stream selected by a frame mask known to the sender and to the receiver, and/or into a particular frame of the main information stream, by imposing a constraint on only some of the bits of the frame selected by a bit mask known to the sender and to the receiver.

The terms sender, receiver, and transmission must be understood in their widest senses. In one example of application to a radio system, the sender and the receiver are terminal equipments of the system and the transmission is radio transmission.

Insertion is effected in a parametric vocoder of the sender which produces said main information stream without modifying its bit rate relative to what it would be with no insertion. In other words, the secondary information stream is interpreted as a series of constraints on the series of values of some parameters of the parametric coding model of the main information stream. Compared to the prior art insertion method, the method of the invention has the advantage that nothing in the main information stream that is transmitted betrays the presence of the inserted secondary information stream. Moreover, limiting insertion to some frames and/or to some bits in a frame preserves the intelligibility of the coded voice signal in the main information stream, which is not the case with the prior art insertion method cited above.

To make insertion more discreet, and thus to strengthen resistance to attempts to pirate the transmission, the frame mask may be variable. It is then generated in accordance with a common algorithm and in parallel in the sender and in the receiver, in order to synchronize coding and decoding the main information stream in the sender and in the receiver, respectively.

The frame mask may advantageously define a subseries of groups of consecutive frames into each of which bits of the secondary information stream are inserted, in order to benefit from the slippage effect of such coding that results from storing the frames in the parametric vocoder. This contributes to preserving the fidelity of the main information stream to the voice signal.

The length in frames of a group of consecutive frames is then preferably substantially equal to the storage depth of the frames in the parametric vocoder.

If the parametric vocoder source model provides, for at least some of the main information stream frames, different bit classes as a function of their sensitivity to the quality of voice signal coding, the bit mask may be such that bits of the secondary information stream are inserted into these frames by imposing a constraint as a matter of priority on the bits belonging to the least sensitive bit class. This also contributes to preserving the fidelity of the main information stream to the voice signal.

The secondary information stream may be a voice data stream having a lower bit rate than the main information stream. This is the case if the secondary information stream comes from another vocoder having a lower bit rate than the parametric vocoder.

Of course, the secondary information stream may also be a transparent data stream.

If the bit rate of the secondary information stream to be inserted is too high relative to the bit rate of the parametric vocoder, it may be necessary to eliminate bits from the secondary information stream, if that is compatible with the application. Conversely, if the bit rate of the secondary information stream is too low, some bits may be repeated or stuffing bits may be introduced.

The secondary information stream is subjected to error corrector coding before inserting it into the main information stream. This alleviates the fact that, in the context of parametric vocoders, some bits of the frames of the main information stream are subjected only to weak error corrector coding, if any, forming channel coding, before transmission.

In one possible embodiment, bits of the secondary information stream are inserted by imposing values on bits that belong to excitation parameters of a filter of the source model of the parametric vocoder, for example adaptive excitation parameters and/or fixed excitation parameters of the linear prediction filter of a CELP vocoder. Not imposing constraints on the bits of the linear prediction parameters preserves the intelligibility of the main information stream. To this end also, it is preferable to impose constraints on the bits forming the fixed excitation parameters rather than on those forming the fixed excitation parameters.

In one embodiment, bits of the secondary information stream may also be inserted into silence frames of the main information stream, instead of or as well as inserting them into voice frames.

In another embodiment, bits of the secondary information stream may be inserted by imposing constraints on non-encrypted bits by way of end-to-end encryption of the main information stream. This enables a receiver, following extraction, to decode the secondary information stream although it does not have the relevant decryption capacity. Of course, the bits concerned can nevertheless be subjected to one or more encryption/decryption operations on some other basis, for example link or radio interface encryption.

For example, the insertion constraint may be a constraint on the quality of the bits of the frame of the main information stream with the bits of the secondary information stream inserted therein.

A second aspect of the invention relates to a parametric vocoder adapted to implement the method constituting the first aspect of the invention. With regard to its coding function, this kind of parametric vocoder includes insertion means for inserting a secondary information stream into a main information stream that is generated by the parametric vocoder from a voice signal. The insertion means are adapted to insert bits of the secondary information stream:

into only some of the frames of the main information stream selected by a particular frame mask, and/or into a particular frame of the main information stream imposing a constraint on only some of the bits of the frame selected by a particular bit mask.

For its decoding function, the vocoder includes means for extracting the secondary information stream from the main information stream.

A third aspect of the invention relates to a terminal equipment of a radio system including a parametric vocoder according to the second aspect of the invention.

DETAILED DESCRIPTION OF PREFERRED EMBODIMENTS

Figure 1:
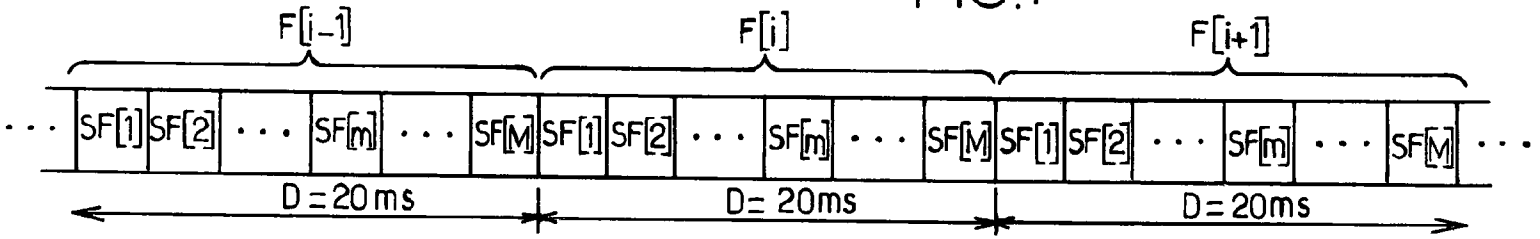
FIG. 1 is a diagram of one example of a coded voice data stream (voice stream) organized into frames and subframes.

FIG. 1 is a diagram showing the general principle of inserting a secondary information stream DS2 into a main data stream DS1 coding a voice signal VS1 in a sender which, after multiplexing and channel coding, sends the stream DS1, and therefore the stream DS2 that it contains, to a distant receiver. The sender and the receiver are, for example, mobile terminals of a public radio system such as the GSM or the UMTS or a professional radio system such as TETRA or TETRAPOL.

The stream DS1 is generated by a vocoder 10 from the voice signal VS1, which is produced by a voice source 1 such as the vocal tract of a person. To this end, the voice signal VS1 is digitized by linear pulse code modulation (PCM) and segmented into frames called voice frames. Moreover, each frame is generally segmented in the vocoder 10 into a fixed number M of segments known as time domain subframes (CELP model) or frequency domain subframes (multi-band excitation (MBE) model). The value of M is typically from 2 to 6, depending on the vocoders. Each frame comprises a particular number N of bits.

Figure 2:
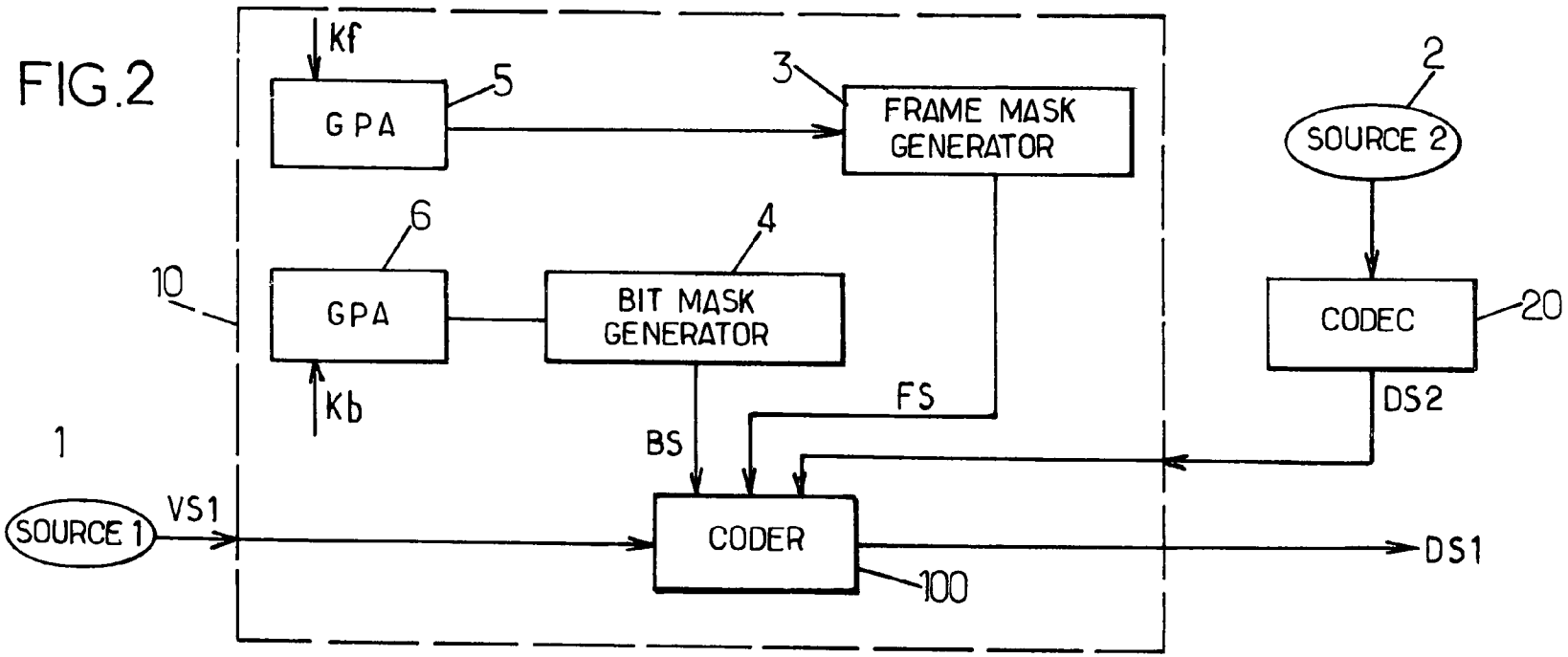
FIG. 2 is a partial block diagram of one example of sender equipment of the invention.

FIG. 2 shows a voice signal digitized and segmented into successive frames F[i] for values of i from zero to infinity. Moreover, for some parameters at least, each frame F[i] can be segmented into M subframes SF[m] for values of m from 1 to M. In the figure, D denotes the duration of a frame.

Referring again to FIG. 1, the vocoder 10 may be a GSM enhanced full-rate (EFR) vocoder (see ETSI specification EN 300 726 GSM 06.60), a UMTS adaptive multi-rate (AMR) vocoder (see ETSI technical specification 3GPP TS 26.101), for which D=20 ms and M=4, a vocoder of a TETRA radio terminal conforming to the ETSI specification EN 300 395-2, or a 6 kbit/s TETRAPOL vocoder (see ITU-R report M.2014), for which D=20 ms, M=3 and N=120.

The secondary data stream DS2 is generated by a codec 20, for example, which receives a data stream to be coded from a source 2. In one example of an application of the invention, the source 2 also sends a voice signal, in which case the codec 2 is a vocoder of lower bit rate than the vocoder 10. In this case, the stream DS2 is also a stream of voice frames. In this application, the invention is used for discreet insertion of a secondary communication into a main communication. The codec 20, more specifically the vocoder 20, may be a multi-frame mixed excitation linear prediction (MF-MELP) vocoder operating at 1200/2400 bit/s described in NATO STANAG 4591.

The stream DS2 may be subjected to error corrector coding, for example cyclic redundancy code (CRC) coding or convolutional coding, which constitutes channel coding with a view to its transmission over the transmission channel. It is known that some bits of the frames of the voice stream DS1 are not protected much, if at all, by channel coding, so that specific protection of the bits of the information stream DS2 may be required, depending on the application.

The vocoder 10 includes a coder 100 which executes a source model (or parametric model) coding algorithm, for example of the CELP or MELP type. In this case, the parameters corresponding to the coding of a voice frame at the sender end include excitation vectors that are subjected at the receiver end to a filter whose response models the voice.

The parametric coding algorithms use parameters calculated either directly as a function of the incoming stream of voice frames and an internal state of the vocoder or iteratively by optimizing a given criterion (over successive frames and/or subframes). The former parameters typically comprise linear prediction (LP) parameters defining a short-term filter and the latter parameters typically comprise adaptive excitation parameters (LTP) defining a long-term filter and fixed excitation parameters. Each iteration corresponds to coding a subframe in a frame of the input stream.

For example, the adaptive excitation parameters and the fixed excitation parameters are selected by successive iterations in order to minimize the quadratic error between the synthesized voice signal and the original voice signal VS1. In the literature this iterative selection is called codebook searching, synthesis search analysis, error minimization loop and closed loop pitch analysis.

As a general rule, the adaptive excitation parameters and/or the fixed excitation parameters may each comprise firstly an index corresponding to a value of a vector in the adaptive dictionary depending on the subframe or in a fixed dictionary, respectively, and secondly a gain value associated with said vector. Nevertheless, in some vocoders, such as the TETRAPOL vocoder, the adaptive and/or fixed excitation parameters define the excitation vector to be applied directly, i.e. without consulting a dictionary addressed by means of an index. No distinction is made below between the mode of defining the excitation vectors. The constraints imposed by the bits of the stream DS2 apply either to the index relating to the value of the excitation vector in the dictionary or to the excitation value itself.

In addition to the main data stream (voice frame stream) DS1 and the secondary data stream DS2, the vocoder 10 of the invention receives a frame mask stream TS and/or a bit mask stream BS.

The stream FS is generated by a frame mask generator 3 from a bit stream received from a pseudorandom generator 5 which uses a secret key Kf known to the sender and the receiver. The function of a frame mask is to select, from a particular number of frames of the voice frame stream DS1, those into which only bits of the secondary data stream DS2 are inserted.

To this end, the generator 3 executes the following process. In the series of frames F[i] of the main stream DS1, let h be a numerical function with integer values, and let k be a particular integer number that is preferably substantially equal to the depth of storage of successive frames in the vocoder 10 (see below, number P, with reference to the FIG. 3 diagram), while the frames F[h(i)], F[h(i)+1], . . . , F[h(i)+k] define what is referred to here as a subseries of groups of frames of the series of frames F[i].

In a preferred embodiment of the invention, the frames subjected to the insertion constraint belong to a subseries of groups of consecutive frames of the main stream DS1. This exploits the slippage effect of the voice coding resulting from the storage of frames in the vocoder 10 in order to preserve the quality of the coding of the voice signal VS1 in the main stream DS1. It is for this reason that the number k, which corresponds to the length in frames of a group of frames, is preferably at least approximately equal to the storage depth R of the vocoder 10, as mentioned above.

For example, by choosing h(i)=10×i and k=5, the frames F[0] to F[5] are subjected to the insertion constraint, the frames F[6] to F[9] are not subjected to the insertion constraint, the frames F[10] to F[15] are subjected to the insertion constraint, the frames F[16] to F[19] are not subjected to the insertion constraint, and so on. In other words, in this example, six of ten consecutive frames are subjected to the insertion constraint.

The stream BS is generated by a bit mask generator 4 from a bit stream received from a pseudorandom generator 6 which uses a secret key Kb also known to the sender and the receiver. The function of a bit mask is to select, from the N bits of a frame of the voice frame stream DS1 selected by the frame mask associated with the current frame F[i], those which are the only ones to be constrained by bits of the secondary data stream DS2.

To this end, the generator 4 executes the following process. It produces a stream of a fixed number Smax of bits, where Smax designates the maximum number of bits of a current frame Fi of the main stream DS1 that may be constrained by bits of the secondary stream DS2. A particular number S of bits from those Smax bits, where S is less than or equal to Smax ($S \leqq Smax$), have the logic value 1, the others having the logic value 0. These Smax bits are inserted into a stream of N bits at fixed positions predefined in the software of the vocoder 10 to form a bit mask covering the frame. This bit mask therefore comprises S bits at 1. In one example, when a bit of the bit mask is at 1, it indicates a position at which a bit of the secondary stream DS2 is inserted into the current frame Fi of the main stream DS1.

The number Smax is set as a compromise between the maximum number of bits of the secondary stream DS2 that may be inserted into a frame of the main stream DS1 and the concern to preserve the quality of coding of the voice signal VS1 in the main stream DS1. The number Smax being fixed, the number S depends on the bit rate of the secondary stream DS2. The ratio S/N defines what might be termed the rate of insertion of the secondary stream DS2 into the main stream DS1 for the current frame F[i], the ratio Smax/N defining the maximum insertion rate.

In an example using a TETRAPOL vocoder (for which N=120) with $h(i)=10\times i$, k=5 and S=50, a channel with an average bit rate of 1215 bit/s is obtained for the insertion of the secondary stream. This bit rate enables the insertion of a 1200 bit/s secondary data stream (necessitating 81 bits in 67.5 ms) generated by an MF-MELP codec described in NATO STANAG 4591. In other words, the insertion rate obtained is sufficient for the discreet transmission of a secondary stream that is also a voice stream generated by a secondary vocoder 20 of lower bit rate than the main vocoder 10.

An example of an insertion constraint consists in replacing (i.e. overwriting) the bits of the main stream DS1 normally generated in accordance with the standard coding algorithm used by the vocoder 10 from the voice signal VS1 with bits of the secondary stream DS2. In other words, the constraints applied to the voice coding parameters of the main stream are equality with bits of the second stream combined with selection constraints by applying the logic AND operator to a bit mask and the bits forming the main stream.

The above example is the simplest, but is not the only one. Algorithms processing the main stream and the secondary stream use any contextual grammar or linear or non-linear algebra, including Boolean algebra and Allen temporal algebra (see the paper "Maintaining Knowledge about Temporal Intervals", Communications of the ACM, 26 Nov. 1983, pp. 832-84), auxiliary memories, if any, and depending on the value of third party parameters, enabling the person skilled in the art to define complex constraints that conform, for example, to statistical properties imposed by the voice model of the main stream.

Note in particular that the set of indices of the excitations in a dictionary is generally a distribution of bits at 0 and at 1 that is totally neutral vis-à-vis a statistical analysis of occurrences. It is generally possible to encrypt the secondary stream DS2 in a pseudorandom form prior to insertion, without modifying the statistical distribution of the 0 and 1 bits in the modified bits of the main stream. Assuming a voice coding model producing a coded stream some subframes whereof would have a correlation towards 0 or toward 1, the pseudorandom generator mentioned above or an algorithm for encrypting the secondary stream should also have this bias.

Clearly the number of bits constrained during coding varies from one frame to the other according to a law of evolution known to the sender and to the receiver, which are assumed to be synchronized.

Synchronization of the sender and the receiver with regard to the application of the frame masks and/or bit masks results from the general synchronization of the two equipments, which is typically achieved by labeling frames with values generated by a frame counter. The general synchronization of the sender and the receiver may result, completely or additionally, from synchronization elements (particular bit patterns) inserted into the main stream DS1. This is known in the art.

The coder 100 of the sender and the decoder of the receiver share the same initial information for determining the subseries of the frame groups and subframes into which the secondary stream was inserted. This information may comprise an initialization vector of the pseudorandom generators 5 and 6. It may be fixed. It may also depend on the average bit rate imposed by the secondary stream, for example, or on non-constrained parameters of the main codec 10 calculated when coding the main stream.

Figure 3:
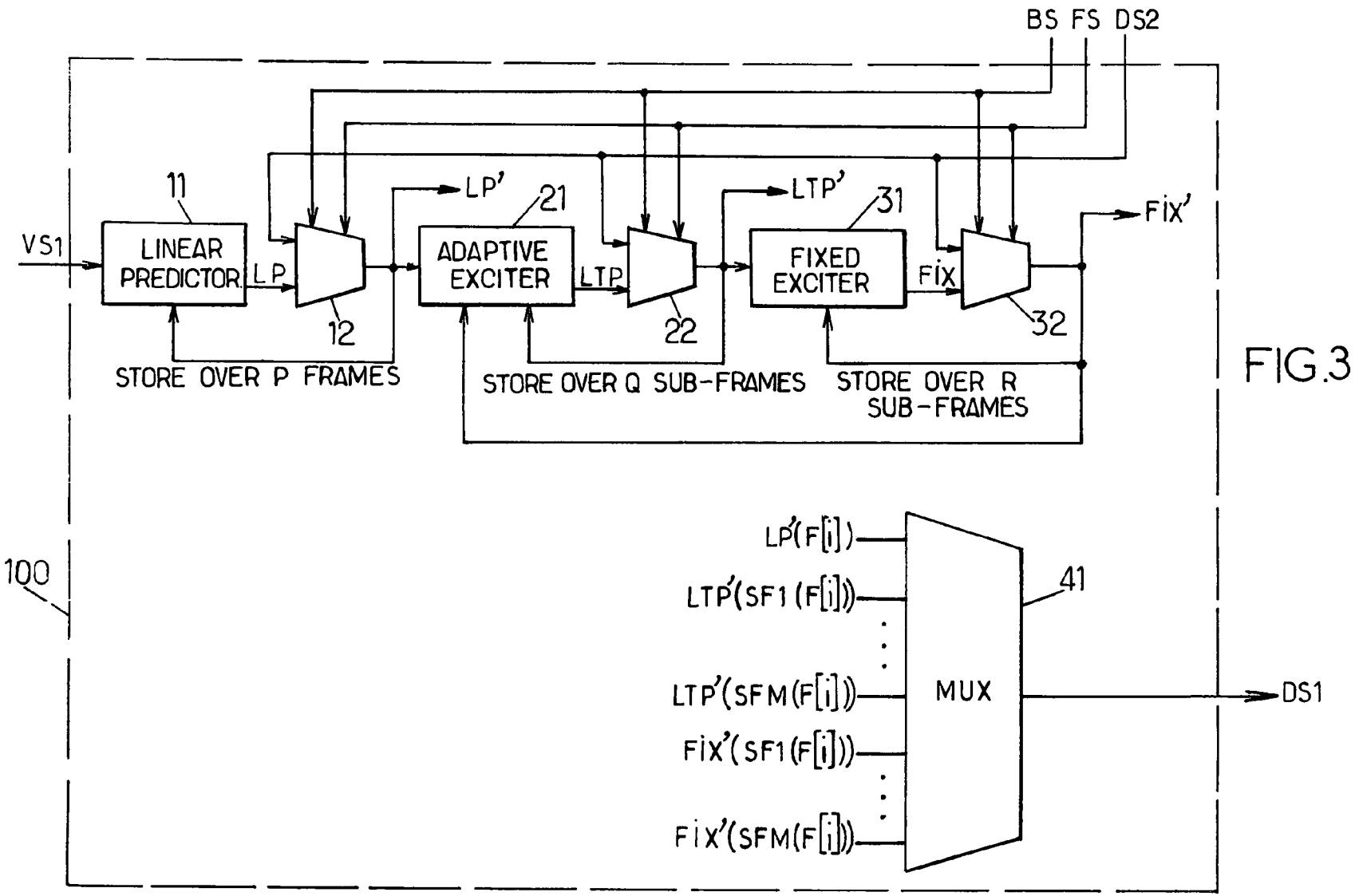
FIG. 3 is a partial block diagram of one example of a vocoder of the invention.

As shown in FIG. 3, the coder 100 includes a hardware and/or software module 11 for synthesizing linear prediction parameters receiving at its input the voice signal VS1 and delivering at its output information LP corresponding to the linear prediction parameters (coefficients of the short-term linear prediction filter). The information LP is fed to the input of a logic unit 12, for example a multiplexer, which is controlled by the frame mask stream FS and the bit mask stream BS. The unit 12 generates at its output information LP' corresponding to the information LP some bits whereof for some frames at least have been degraded by applying constraints resulting from the secondary stream DS2 via the frame mask and the bit mask both associated with the current frame. The module 11 may store the information LP' with a storage depth corresponding to a particular number P of successive frames.

The coder 100 also includes a hardware and/or software module 21 for synthesizing adaptive excitation parameters receiving at its input the information LP' and delivering at its output information LTP corresponding to the adaptive excitation parameters (defining a first quantization vector and an associated unity gain for the short-term synthesis filter). The information LTP is fed to the input of a logic unit 22, for example a multiplexer, that is controlled by the frame mask stream FS and the bit mask stream BS. The unit 22 generates at its output information LTP' corresponding to the information LTP some bits whereof for some frames and/or for some subframes at least have been degraded by applying constraints resulting from the secondary stream DS2 via the frame mask and the bit mask both associated with the current frame. The module 21 may store the information LTP' with a storage depth corresponding to a particular number Q of successive subframes of the current frame ($Q \leqq M-1$).

The coder 100 finally comprises a hardware and/or software module 31 for synthesizing fixed excitation parameters receiving at its input the information LTP' and delivering at its output information FIX corresponding to the fixed excitation parameters (defining a second quantizing vector and an associated unity gain for the short-term synthesis filter). The information FIX is fed to the input of a logic unit 32, for example a multiplexer, that is controlled by the frame mask stream FS and the bit mask stream BS. The unit 32 generates at its output information FIX' corresponding to the information FIX some bits whereof for some frames and/or for some subframes at least have been degraded by applying constraints resulting from the secondary stream DS2 via the frame mask and the bit mask both associated with the current frame. The module 21 may store the information FIX' with a storage depth corresponding to a particular number R of successive subframes of the current frame (R≦M−1). Moreover, the module 21 may store the information FIX' with a storage depth corresponding, for example, to a particular number W of successive subframes of the current frame (W≦M−1).

For each current frame, the information LP' (F[i]) corresponding to the linear prediction parameters of the frame, the information LTP' (SF[1]), . . . , LTP' (SF[M] corresponding to the respective adaptive excitation parameters for each of the subframes SF[1] to SF[M] of the frame, and the information FIX' (SF[1]), . . . , FIX' (SF[M] corresponding to the respective fixed excitation parameters for each of the subframes SF[1] to SF[M] of the frames are transmitted to the input of a multiplexer 41 that concatenates them to form a frame of the main stream DS1.

The storage operations referred to above attenuate the effect of the constraints applied to the bits of the linear prediction parameters, the adaptive excitation parameters and/or the fixed excitation parameters in relation to the fidelity of the main stream DS1 to the source voice signal VS1. These storage operations provide a slippage effect in the calculation of the parameters so that, for a given frame, the constraints applied to first parameters are at least partly compensated, from the perceptual point of view, by the calculation of parameters thereafter from a voice synthesis based on said first parameters.

To be more specific, the following equations may be written, in which f designates a function reflecting analysis by synthesis:

1) LP' (F[i])=f(LP' (F[i−1]), LP' (F[i−2]), . . . , LP' (F[i−P])
2) LTP' (SF[i])=f(LTP' (SF[i−1]), . . . , LTP' (SF[i−R]), FIX' (SF[i−1]), . . . , FIX' (SF[i−W])
3) FIX' (SF[i])=f(FIX' (SF[i−1]), . . . , FIX' (SF[i−W])

The above compensations and the fact the insertion of the bits of the secondary stream is not random enable some vocoders to achieve in practice insertion rates of the order of 10% without degrading (from the perceptual point of view) the voice signal VS1 by more than a residual bit error rate (after channel coding) of the order of a few percent.

The implications of the method at the receiver end are discussed next.

Note first that, for a receiver equipment that does not process the secondary stream DS2, the received frames of the stream DS1 are decoded only in accordance with the standard synthesis algorithm of the vocoder 10 of the sender equipment.

For a receiver equipment processing the secondary stream DS2, recovering the information coded by the bits of the secondary stream necessitates synchronization of the receiver equipment with the sender equipment, and means for extracting the secondary stream DS2 from the main stream DS1 identical to the codec 20 of the sender equipment.

Figure 4:
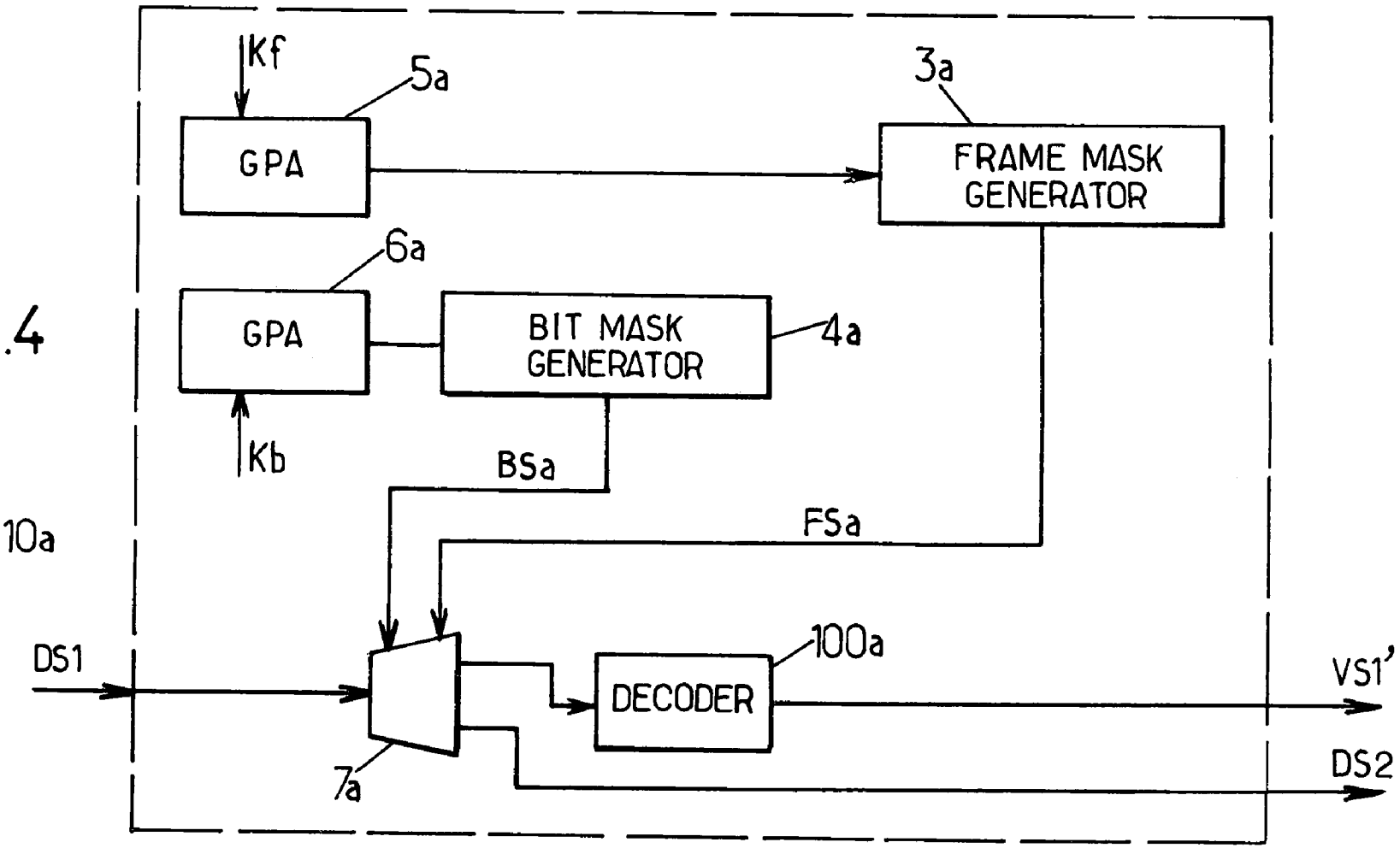
FIG. 4 is a partial block diagram of one example of a vocoder used in a receiver of the invention.

The FIG. 4 diagram shows the means of a vocoder 10*a* of receiver equipment adapted to process the secondary stream transmitted by the method of the invention.

The vocoder 10*a* receives the main stream DS1 at its input, where appropriate after demultiplexing and channel decoding, and delivers a voice signal VS1' at its output.

The signal VS1' is less faithful to the source voice signal VS1 (FIG. 3) than it would be in the absence of the insertion method of the invention. This reflects the loss of quality of the coding effected at the sender end because of external constraints applied to the vocoder 1 of the sender equipment.

The receiving equipment may also include means for reproducing the voice signal VS1', for example a loudspeaker or the like.

As mentioned above, prior art transmission protocols provide for general synchronization of the receiver equipment with the sender equipment. Implementing the invention therefore does not require any particular means in this respect.

For extracting the secondary stream, the vocoder 10*a* includes a frame mask generator 3*a* and a bit mask generator 4*a* respectively associated with a pseudorandom generator 5*a* and a pseudorandom generator 6*a* that are identical and arranged in the same way as the respective means 3, 4, 5 and 6 of the vocoder 10 of the sender equipment (FIG. 3). Note that the generators 5*a* and 6*a* of the receiver equipment receive the same secret keys Kf and Kb, respectively, as the generators 5 and 6 of the vocoder 10 of the sender equipment. Those keys are stored in an ad hoc memory of those equipments. The generators 3*a* and 4*a* respectively generate a frame mask stream FSa and a bit mask stream BSa. These are supplied to the input of a decoder 100*a* of the vocoder 10*a*.

The bits of the secondary stream DS2 are extracted by the synchronous application (for example using logic AND operators) of the frame masks and the bit masks at the input of the decoder 100*a* (for example using logic AND operators), without this affecting the decoding of the main stream DS1 by the latter decoder. To this end, the stream DS1 is applied to the input of the decoder 100*a* via a logic unit 7*a* that extracts the secondary information stream DS2 from the main information stream DS1 under the control of the frame mask stream FSa and the bit mask stream BSa.

The receiver equipment may also include a secondary codec identical to the codec 20 of the sender equipment for decoding the secondary stream DS2. If that stream is a voice stream, the secondary codec generates a voice signal that may be reproduced via a loudspeaker or the like.

Note that the fluctuation of the rate of transmission of the bits of the secondary stream DS2 does not give rise to any particular problem at the receiver end, provided that the secondary stream DS2 is supplied to the input of a variable bit rate secondary codec, as is the case with all commercially available vocoders. This kind of codec includes an input buffer in which the data of the stream DS2 is stored for decoding it. The input buffer must never be empty. To this end, the appropriate insertion rate is determined taking account in particular of the bit rate of the coder 100 and the secondary vocoder 20 and the objectives of preserving the fidelity of the main stream DS1 to the voice signal VS1. Given the high insertion rates obtained in practice (which are of the order of 10%), feeding the secondary vocoder of the receiver equipment should not give rise to problems with an AMR type main vocoder 10 in its 12.2 kbit/s coding mode and a secondary vocoder 20 with approximately one-tenth the bit rate.

Moreover, to supply the second decoder with a regular stream of frames when the secondary stream is a voice stream, the sequences may optionally be stored and decoding deferred.

If the secondary stream is a transparent data stream, it is proposed to concatenate the data, to process it as if it had been transmitted by means of a maximum length short message (a GSM SMS message, for example), and to add to it a convolutional error corrector code. Alternatively, the transparent data stream may be sent to an encryption module or to a text-to-speech transcoder and synthesizer module.

We return now to the general description of embodiments of the transmission method of the invention.

The bits of a particular frame of the main stream to be subjected to the application of the constraint of the secondary stream are chosen in accordance with the specifics of each application. Several possible embodiments in this respect are described hereinafter, together with other specifics and advantages of the invention.

In one possible embodiment, constraints are imposed when coding to the value zero several or all the bits of the frame that are associated with a particular type (adaptive or fixed) excitation vector, before effecting the iterations for calculating the parameters that depend on said excitation vector by virtue of the storage operations effected in the vocoder. Those bits of constrained value then constitute the information of the secondary stream transported by the frame and thus constitute the channel of the secondary information stream DS2. In other words, the secondary stream is inserted by imposing values on bits forming the parameters of the adaptive or fixed excitation vectors. Where appropriate this may be extended by simultaneously applying constraints to the excitation vectors of the other type (respectively fixed or adaptive).

If transmission between the sender and the receiver provides for partial encryption of the frames of the main stream (i.e. encryption of only some bits in each frame), the bit mask may advantageously coincide with a set of non-encrypted bits of a frame. This enables the gateway receiver equipment to extract the secondary stream inserted into the main stream without having to include means for decrypting the main stream.

At the same time as preserving the confidentiality of the main stream, this is particularly beneficial for assuming approximate linearity of the voice model of the vocoder, i.e. considering that the residual or vocal chord excitation parameters are not correlated with the coefficients describing the spectral envelope of the vocal tract's response.

In other words, this embodiment of the method is characterized in that inserting the secondary information stream imposes constraints on non-encrypted bits of parameters of the voice model of the main stream.

This embodiment is illustrated by an example relating to the EFR vocoder (see above) used as the main codec. The choice is made to use bits from the unprotected bits of each frame as a channel for the secondary stream, by overwriting their value calculated by the source coding algorithm of the main stream by applying a bit mask to the 78 unprotected bits of each frame. These 78 unprotected bits are identified in table 6: "Ordering of Enhanced Full Rate Speech Parameters for the Channel Encoder" of the ETSI specification EN 300 909 V8.5.1 GSM 05.03 "Channel coding", and relate to a subset of the bits describing the fixed excitation vectors. With these 78 class 2 bits per 20 ms frame, a secondary channel is obtained having a nominal bit rate of 3900 bit/s. It is preferable to use the less sensitive bits of the 12.2 kbit/s coding mode of the AMR codec (see above) identified in order of sensitivity in table B.8: "Ordering of the Speech Encoder Bits from the 12.2 kbit/s Mode" of the 3GPP technical specification TS 26.101 "Adaptive Multi-Rate (AMR) Speech Codec Frame Structure".

It is therefore equally possible, in the 12.2 kbit/s coding mode of the AMR codec, to introduce the stream from a secondary codec, for example the 1200/2400 bit/s MELP coder described in NATO STANAG 4591, necessitating 81 bits per 67.5 ms at 1200 bit/s (respectively 54 bits per 22.5 ms 2400 bit/s) encapsulated in its own error corrector coding (⅔ rate FEC), for example, which protects 100% of the bits at 1200 bit/s (respectively 50% of the bits at 2400 bit/s) and/or encapsulated in security interoperability negotiation frames of the future narrowband digital terminal (FNBDT) type defined by NATO, or a lighter type of security protocol.

In another embodiment, applicable to vocoders using an algorithm based on the selection of quantified excitations in a dictionary, the constraint consists in imposing a particular excitation value from the dictionary. Alternatively, the dictionary is divided into a plurality of subdictionaries and the constraint consists in imposing one of the subdictionaries. Another option is to combine the above two types of constraint. When decoding the main stream at the receiver end, the knowledge of the excitation received enables the subdictionary and/or the excitation concerned to be identified and the constraint that determines the bits of the secondary stream to be deduced therefrom. Note that, ignoring permutation of the excitations, the subdictionary imposition constraint may be equivalent to the application of the constraints to the less significant bits of the excitation indices in the dictionary.

In another embodiment, the secondary stream defines differential coding of the indices of excitation vectors, for example of fixed excitation vectors, in the subseries of successive frames of the main stream.

In another embodiment, the constrained bits may be the less significant bits of the fixed excitations (i.e. the non-adaptive excitations) for each voice frame and where appropriate for each subframe defined in the voice frame in the sense of the coding algorithm of the vocoder 10.

In another embodiment, the number and the position of the constrained bits are identified for each successive frame as a function of an algorithm for calculating a mask and a secret element known to the sender and the receiver, in order to increase the chances of non-detection by a third party of the existence of the secondary stream.

Another embodiment, applicable to a coding algorithm necessitating a plurality of fixed excitation vectors for each frame or subframe, such as the CELP codec for the voice content of an MPEG-4 stream (defined in ISO/IEC specification 14496-3 sub-part 3) for which some fixed excitations of a frame are chosen on the basis of previous calculations and where other fixed excitations of the same frame are calculated by analysis by synthesis using a dictionary (see the ISO/IEC specification 14496-3 Section 7.9.3.4 "Multi-Pulse Excitation for the bandwidth extension tool"), consists in imposing the constraint on the choice by means of the dictionary of the first fixed excitation and thereafter using the synthesis analysis iterations for the second fixed excitation to make good the error imposed by the constraint on the first fixed excitation.

In another embodiment, the subseries of frames of the main stream to which the insertion of the secondary stream relates include only frames that have sufficient energy and sufficient voice in the vocoder sense. In a variant applicable to MELP vocoders, for example, which define a plurality of voicing levels, or to harmonic vector excitation codec (HVXC) vocoders, which are parametric MPEG-4 voice stream vocoders defined in the ISO/IEC specification 14496-3 Subpart 2, the subseries concerns only the segments of the frames that are not voiced or not voiced very much.

When the constraint is applied to the excitation parameters, for example to the fixed excitation indices, the parameters of a subframe of the main stream DS1 continue to conform completely to the voice coding model of the vocoder 10. Nevertheless, the sequence of modified fixed excitations is perhaps statistically atypical for a human voice or possibly atypical for the speaker recognition process, depending on the constraints applied and the required fidelity objective. To prevent the presence of the secondary stream in these excitations being detected in a receiver, processing of the parameters including smoothing of the gains of the fixed excitations associated with processing of the isolated pulses of the excitation vectors followed by post-filtering after voice synthesis may be applied during decoding. These processes exclude sound sequences appearing after transmission in a noisy channel that would be impossible for a human voice tract to pronounce in the surroundings of a microphone. This refers, for example, to some sequences of clicks, hisses, squeals, whistles, etc. in the background noise that the standard vocoder did not filter sufficiently during voice synthesis because of the constraints imposed. Thus unwanted unvoiced sounds that would be correlated with the constrained fixed excitation sequences of the invention may be rendered imperceptible.

Nevertheless, if the application of constraints risks perception of undesirable unvoiced sounds correlated to a fixed excitation sequence atypical of a human voice and not filtered by the filtering applied by the standard decoder of the vocoder, the subseries of frames to which the constraints are applied may be defined as a function of previous statistical analyses of the values of the consecutive parameters of the voice model of the vocoders, for example exploiting the texture of the parameters of the voice, defined by an inertia, an entropy or an energy derived from the probability of the sequences of values of the parameters, for example in eight consecutive frames representing the duration of a phoneme.

For each embodiment, the performance of the synthesis of the main stream DS1, i.e. the fidelity to the signal VS1, is inversely proportional to the relative bit rate of the secondary stream DS2. The required performance in terms of subjective fidelity of the voice signal VS1 to the source 1 may nevertheless be achieved if the proposed method keeps invariant some subjective attributes of the source 1 (for example some psycho-acoustic criteria thereof). It may be measured by statistical measurements (Mean Opinion Score (MOS)) against a standardized scale (see ITU-T Recommendation P.862 "Perceptual evaluation of speech quality—PESQ").

In some embodiments, to justify the application of the proposed method, the degraded subjective quality of the voice stream DS1 from the vocoder 10 caused by the insertion of the secondary stream DS2 is assumed to be acceptable. This is the case in particular if the secondary stream is also a voice stream and for the legitimate hearer the auditory content of the main stream is much less important than the content of the secondary stream. The psycho-acoustic perception of the possible presence of the secondary stream when listening to the decoded and reproduced main stream provides no assistance with locating the secondary stream in the main stream and therefore no formal proof of its existence. This is the case in particular for a low bit rate vocoder 10 used in a noisy environment, as decoding and reproducing the main stream DS1 supply voice sequences conforming to the model of the vocoder 10. This is also the case, within certain psycho-acoustic limits, if a minimum bit rate of the secondary stream must be assured to the detriment of the quality of reproduction of the main stream.

To preserve the intelligibility of the synthesis of the main stream DS1 as much as possible, it is preferable not to apply constraints to the linear prediction (LP) spectral parameters defining the short-term filter and not to interfere unduly with the long-term parameters (LTP) adapted to each subframe, in order to retain subjective characteristics deemed to be essential in the voice signal VS1. In particular, one preferred embodiment consists in applying the constraints to subframes different from the subframes on which the long-term analysis windows of the frame are concentrated, for example the second and fourth subframe for the 12.2 kbit/s coding mode of the AMR vocoder referred to above (see the 3GPP technical specification TS 26.090 V5.0.0, Section 5.2.1 "Windowing and auto-correlation computation"). In particular this avoids interfering with many voiced segments, generally conveying most of the speaker identification characteristics.

Taking a more sophisticated example, in the 12.2 kbit/s coding mode of the AMR vocoder, it is possible to impose a constraint on the choice of adaptive excitation by imposing initial values on the samples u(n) for n=0, . . . , 39 in the recursive equation (38) for calculating the adaptive vector described in section 5.6.1 ("Adaptive Codebook Search") of the 3GPP technical specification TS 26.090 referred to above, by substituting 40 values extracted from the secondary stream for the residual LP values calculated using equation (36). The discrepancy between the main stream signal and the signal synthesized by the short-term filter with the contribution of the constraint adaptive vector is compensated by choosing a fixed excitation vector that tends to compensate for the residual error (for example the residual quadratic error) of the long-term prediction over the same subframe as well as the excitation vectors of the successive subframes. Thus the constrained excitation vectors code the secondary stream as an adaptive residue on top of the response of the short-term synthesis filter of the main stream corrected by the fixed residue.

In another example, for a voice model of a sinusoidal transform coding (STC) or multi-band excitation (MBE) parametric vocoder, for example, conforming to the specifications standard ANSI/TIA/EIA 102.BABA ("APCO Project 25 Vocoder Description"), one embodiment leads to considering the less significant bits of the amplitude parameters of the harmonics of the segments of the frames or the amplitude parameters of samples of the spectral envelope. In an MBE codec, the excitation parameters are the fundamental frequency and the voiced/unvoiced decision for each frequency band.

There are described above embodiments that insert bits of the secondary stream into voice frames of the main stream. The main stream DS1 also contains silence frames, which are frames coded by the vocoder 10 with a lower bit rate and sent less often than the voice frames, for synthesizing silence frames referred to as comfort noise when the voice signal VS1 contains periods of silence.

One embodiment of the method may instead or additionally provide for inserting the secondary stream via numerical constraints on the values of the parameters describing the main stream comfort noise to be generated.

This embodiment is illustrated by an example relating to using an EFR or AMR codec (see above) as the main codec. In the GSM and the UMTS, the frames transporting comfort noise (silence frames) are called SID frames (see, for example, the ETSI technical specification 3GPP TS 26.092 "Mandatory Speech Codec Speech Processing Functions; AMR Speech Codec; Comfort Noise Aspects"). To be more precise, the frames concerned here are the SID-UPDATE frames that contain 35 bits of comfort noise parameters and an error corrector code on seven bits.

In the GSM or the UMTS, it is the source that controls the sending of silence frames, i.e. the codec of the sender (subject to interaction with voice activity detection and discontinuous transmission, in particular on the downlink channel from the relay to the mobile terminal). It is therefore possible to proceed by inserting the second stream by a method similar to that applicable to a frame containing sufficient voice energy (voice frame).

Alternatively, it is possible to command the sending of a particular silence frame from the digitized analog input of the codec, generating analog comfort noise representing 35 bits of the secondary stream. In the GSM and the UMTS, the frequency of the silence frames is controlled by the source or by the relay and corresponds to a silence frame every 20 ms, every 160 ms or every 480 ms in the case of the GSM EFR codec. This determines the maximum bit rate for the secondary stream in this variant of the method.

In one particular embodiment, it is possible to use the duplex transmission channel to send silence frames when the speaker is a second participant in the call or in silences in a first conversation, i.e. between the groups of phonemes sent in the main stream.

Note that the 3GPP technical specification TS 26.090 specifies that the size of the comfort noise coding field of the EFR codec, namely 35 bits per silence frame, is identical to the size of the fixed excitation parameter for the same codec. This means that the same constraints may be applied and a permanently minimized insertion bit rate obtained using all the frames independently of the nature (voice or silence) of the main stream.

The invention claimed is:

1. A method of transmitting a secondary information stream between a sender and a receiver, the method comprising:

generating a main information stream by encoding a voice data stream using a parametric vocoder, the main information stream comprising a plurality of frames, inserting bits of the secondary information stream in the parametric vocoder into only some of the frames of the main information stream that are selected by a frame mask known to the sender and to the receiver, and, transmitting the main information stream and bits of secondary information to the receiver.

2. The method according to claim 1, wherein the frame mask is variable and is generated in parallel in the sender and in the receiver using a common algorithm.

3. The method according to claim 1, wherein the frame mask defines a subseries of groups of consecutive frames in each of which bits of the secondary information stream are inserted.

4. The method according to claim 3, wherein the length in frames of a group of consecutive frames is substantially equal to the depth of storage of the frames in the parametric vocoder.

5. The method according to claim 1, wherein, a source model of the parametric vocoder providing, for at least some of the frames of the main information stream, different classes of bits as a function of their sensitivity to a quality of voice signal coding, wherein the bits of the secondary information stream are inserted into said at least some of the frames, by imposing a constraint as a matter of priority on the bits belonging to the least sensitive bit class.

6. The method according to claim 1, wherein the secondary information stream is a voice data stream from another vocoder having a lower bit rate than the parametric vocoder.

7. The method according to claim 1, wherein the secondary information stream is a transparent data stream.

8. The method according to claim 1, wherein the secondary information stream is subjected to error corrector coding before inserting it into the main information stream.

9. The method according to claim 1, wherein bits of the secondary information stream are inserted by imposing values on bits that belong to excitation parameters of a filter of a source model of the parametric vocoder.

10. The method according to claim 1, wherein bits of the secondary information stream are inserted into silence frames of the main information stream.

11. The method according to claim 1, wherein bits of the secondary information stream are inserted by imposing a constraint on unencrypted bits in relation to end-to-end encryption of the main information stream.

12. The method according to claim 1 wherein the bits of secondary information are inserted into a particular frame of the main information stream, by imposing a constraint on only some of the bits of said particular frame selected by a bit mask known to the sender and the receiver.

13. A parametric vocoder for inserting a secondary information stream into a main information stream between a sender and a receiver that is generated by the parametric vocoder from a voice signal, the parametric vocoder comprising:

insertion means adapted to insert bits of the secondary information stream into only some of the frames of the main information stream that are selected by a frame mask, and transmitting means adapted to transmit the main information stream with bits of secondary information to the receiver.

14. The parametric vocoder according to claim 13, wherein the frame mask is variable and is generated by an algorithm based on a secret key.

15. The parametric vocoder according to claim 13, wherein the frame mask defines a subseries of consecutive frames into each of which bits of the secondary information stream are inserted.

16. The parametric vocoder according to claim 15, wherein the length in frames of the subseries of consecutive frames is substantially equal to the depth of storage of the frames in the parametric vocoder.

17. The parametric vocoder according to claim 13, wherein, the source model of the parametric vocoder providing, in at least some of the frames of the main information stream, different classes of bits as a function of their sensitivity to the quality of voice signal coding, wherein the bits of the secondary information stream are inserted into said at least some of the frames, by imposing a constraint as a matter of priority on the bits belonging to the least sensitive bit class.

18. The parametric vocoder according to claim 13, further including means for subjecting the secondary information stream to error corrector coding before inserting it into the main information stream.

19. The parametric vocoder according to claim 13, wherein the insertion means are adapted to insert bits of the secondary information stream by imposing values on bits that belong to excitation parameters of a filter of the source model of the parametric vocoder.

20. The parametric vocoder according to claim 13, wherein the insertion means are adapted to insert bits of the secondary information stream into silence frames of the main information stream.

21. The parametric vocoder according to claim 13, wherein the insertion means are adapted to insert bits of the secondary information stream by imposing constraints on unencrypted bits in relation to end-to-end encryption of the main information stream.

22. Terminal equipment of a radio system including a parametric vocoder according to claim 13.

23. The parametric vocoder of claim 13 wherein the insertion means is further adapted to insert bits of the secondary information stream into a particular frame of the main information stream selected by a bit mask known to the sender and the receiver by imposing a constraint on only some of the bits of said particular frame.

* * * * *